United States Patent [19]

Watkins et al.

[11] Patent Number: 4,595,053

[45] Date of Patent: Jun. 17, 1986

[54] METAL-TO-METAL SEAL CASING HANGER

[75] Inventors: Bruce J. Watkins, Rancho Palos Verdes; Marcelo P. Rosero, Buena Park, both of Calif.

[73] Assignee: Hughes Tool Company, Houston, Tex.

[21] Appl. No.: 622,603

[22] Filed: Jun. 20, 1984

[51] Int. Cl.[4] ..... E21B 33/04; E21B 40/00

[52] U.S. Cl. ..... 166/209; 166/115; 166/217; 166/382; 166/387; 277/116; 277/116.2; 277/118; 277/236; 285/141; 285/382.5

[58] Field of Search ..... 166/206, 208, 209, 217, 166/115, 88, 348, 382, 387; 277/3, 27, 30, 103, 115, 116, 117, 118, 116.2, 235 R, 236; 285/140, 141, 331, 342, 382, 382.1, 382.2, 382.4, 382.5

[56] References Cited

U.S. PATENT DOCUMENTS

| | | | |
|---|---|---|---|
| 3,134,610 | 5/1964 | Musolf | 166/88 X |
| 4,178,020 | 12/1979 | Dopyera | 285/342 X |
| 4,469,172 | 9/1984 | Clark | 166/217 X |

OTHER PUBLICATIONS

SG Wellhead Systems Metal-to -Metal Casing Annulus Seal.

The McEvoy "Z-1" Wellhead System.

*Primary Examiner*—Stephen J. Novosad

*Assistant Examiner*—John F. Letchford

*Attorney, Agent, or Firm*—James E. Bradley

[57] ABSTRACT

A hanger for hanging a string of conduit within a wellhead has a metal-to-metal seal. The hanger has a body that locates within the wellhead and provides an annular clearance between the body and the wellhead. A locking device fits within this clearance to lock the hanger against axial movement. The metal-to-metal seal is an annular ring with inner and outer cylindrical sidewalls. The seal has a cavity into which a wedge ring is driven to urge the sidewalls apart to embed within the hanger body and wellhead bore. The locking device has reacting wedges that urge a split ring outward into engagement with the wellhead. A retaining mechanism is then moved downwardly with the seal to retain the split ring in locking engagement.

6 Claims, 3 Drawing Figures

METAL-TO-METAL SEAL CASING HANGER

BACKGROUND OF THE INVENTION

1. Field of the Invention

This invention relates in general to subsea wellhead equipment, and in particular to a casing or tubing hanger having a metal-to-metal seal.

2. Description of the Prior Art

A typical subsea wellhead assembly includes a wellhead housing mounted within a temporary guide base that is supported on the ocean floor. Large diameter conductor pipe is secured to the wellhead housing and extends downward into the each a short distance. A wellhead is mounted inside the wellhead housing and to a permanent guide base which mounts on top of the temporary guide base. Surface casing secured to the wellhead extends a few hundred feet down into the well. The top of the wellhead is connected to pressure equipment and risers that extend to a drilling vessel at the surface. As the well is drilled deeper, a first string of casing may be set to a certain depth. Subsequently, a second string of casing may be set.

In a typical installation, the casing hanger includes a casing hanger body which is secured to the upper end of the casing string. The body is supported on an annular shoulder in the wellhead. After cementing, a seal and locking means is lowered into an annular clearance between the casing hanger body and wellhead bore. The seal normally includes an elastomeric ring which is compressed by compression rings between the casing hanger body and the wellhead bore. The locking means includes a split ring and various wedges, which are actuated by rotation of a running tool to lock the elastomeric seal in compression and to lock the casing hanger in the wellhead. Wickers, which are small parallel grooves, may be located in the wellhead bore for engagement by the split ring.

While successful, elastomeric seals may not have as long of a life as a metal-to-metal seal, particularly if subjected to heat. Metal seals, and combinations of metal and rubber seals, are commercially available. Improvements, however, are desirable.

SUMMARY OF THE INVENTION

In this invention, a casing or tubing hanger is provided with a metal-to-metal seal. The casing hanger has a body which is dimensioned to define an annular clearance between the wellhead and the body. Locking means is positionable in the annular clearance for locking the body to the wellhead. A deformable metal seal ring is also positioned in the clearance for sealing between the hanger body and the wellhead. The seal ring has inner and outer sidewalls that are cylindrical. Wedge means urges these sidewalls radially apart to seal the body to the wellhead.

In the preferred embodiment, the seal ring is "U" shaped, having an upwardly facing cavity between the inner and outer sidewalls. A metal wedge ring, when pressed into the cavity, urges the sidewalls apart. Wickers are preferably formed on the casing hanger body and on the wellhead bore. The metal seal ring embeds into the wickers to provide sealing.

Preferably, the locking means has a split ring that engages another set of wickers in the bore. Wedges move the ring out into engagement. Wedge fingers movably mounted to the hanger body retain the split ring in locking engagement. The wedge fingers are moved into locking engagement by contact with the metal seal ring prior to its deformation.

DESCRIPTION OF THE PREFERRED EMBODIMENT

Figure 1:
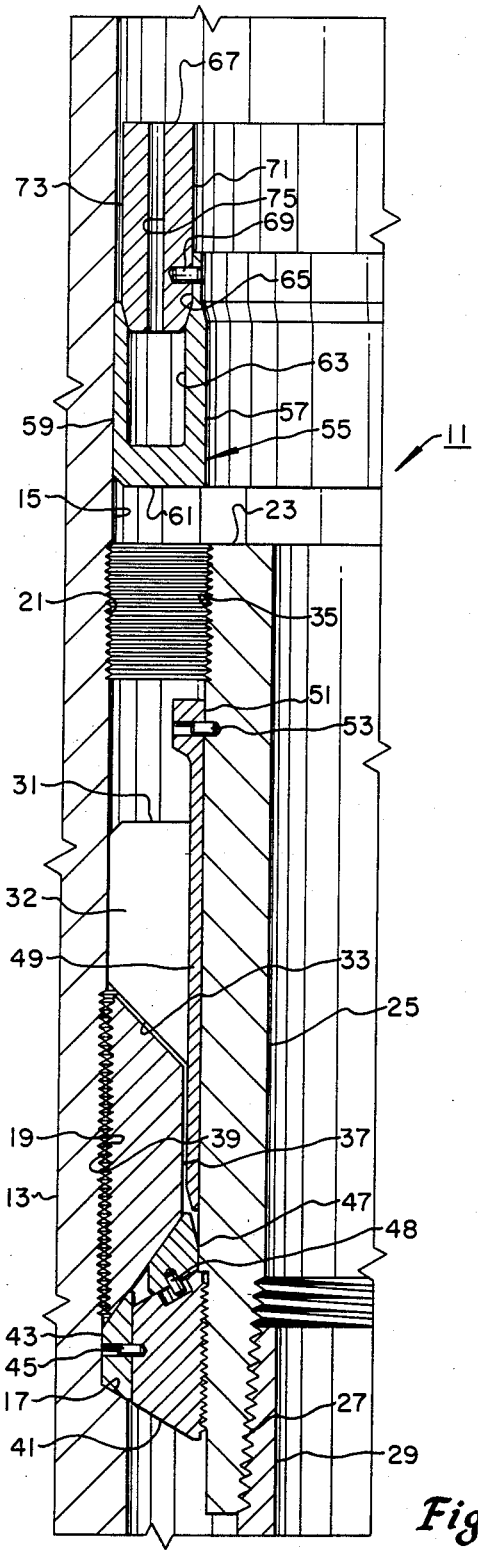
FIG. 1 is a partial vertical sectional view of a casing hanger constructed in accordance with this invention and shown prior to setting.

Referring to FIG. 1, casing hanger 11 is shown located within a subsea wellhead 13. Wellhead 13 has a bore 15 with an upwardly facing annular shoulder 17. A lower set of wickers 19 are formed in the bore 15 a short distance above shoulder 17. Wickers 19 are small parallel and circular grooves formed perpendicular to the axis of bore 15. Preferably there are about eight grooves per inch. An upper set of wickers 21 is located above wickers 19 a selected distance.

The casing hanger 11 includes a hanger body 23 that has an axial passage 25 having threads 27 at the lower end for securing to the upper section of a string of casing 29, which could be tubing if hanger 11 is used as a tubing hanger. Body 23 has an exterior flange 31 located intermediate the upper and lower ends of the body 23. Flange 31 extends radially outward and contacts the wellhead bore 15. Flange 31 has a plurality of vertical slots 32 extending radially outward and spaced circumferentially around the flange. The flange 31 has a reacting surface 33 on the lower side which is inclined so that it faces downwardly and outwardly. The wall of the hanger body 23 above flange 31 and below the reacting surface 33 is cylindrical and spaced inwardly from the bore 15, defining annular clearances between bore 15 and hanger body 23. A set of wickers 35 are formed on the upper end of the hanger body 23 on the exterior surface in alignment with the wickers 21 formed in the wellhead bore 15. Wickers 35 are of the same size and type as the wickers 21 and 19.

Hanger body 23 is supported in the wellhead 13 by a locking means that includes a split ring 37. Split ring 37 is a circular ring that will move from a radially inward position shown in FIG. 1 to a radially outward position shown in FIG. 2. Passages (not shown) in the split ring 37 allow fluid to flow through the ring. The exterior surface of split ring 37 is cylindrical and contains a plurality of wickers 39, which align with the wickers 19 in the wellhead bore 15. A retaining pin 40 (FIG. 2), orients the split ring 37 with the hanger body 23, but allows radial movement with respect thereto.

The casing hanger 11 has reacting means for moving the split ring radially outward when the casing hanger 11 is seated upon the wellhead shoulder 17. The reacting means includes the reacting surface 33 and also three wedge shaped rings, 41, 43 and 47. The inner ring 41 is stationarily carried by the body 23 by means of threads. Inner ring 41 has passages (not shown) that allow fluid to flow upward through ring 41. An outer ring 43 is slidable carried on the cylindrical outer wall of the inner ring 41. Outer ring 43 is secured to the inner ring 41 by means of a shear pin 45. The outer surface of outer ring 43 is cylindrical and contacts the wellhead bore 15. The lower surface of the outer ring 43 is tapered for contacting the tapered shoulder 17. The upper surface of the outer ring 43 is tapered for mating contact with the tapered lower edge of the split ring 37.

Figure 2:
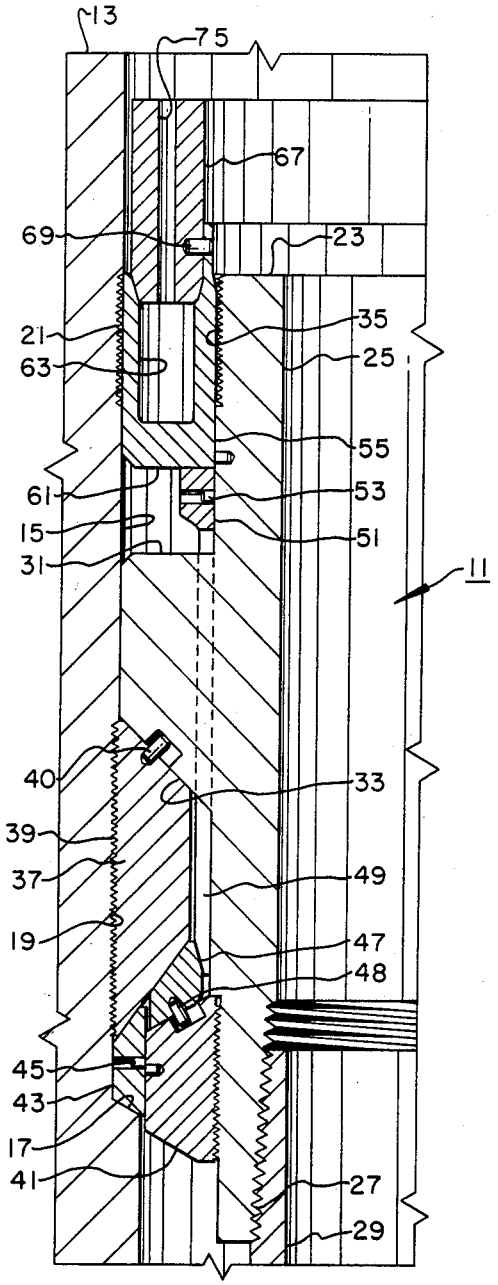
FIG. 2 is a view of the casing hanger of FIG. 1, taken from a different vertical section than in FIG. 1 and shown with the locking means set and the seal means prior to setting.
Figure 3:
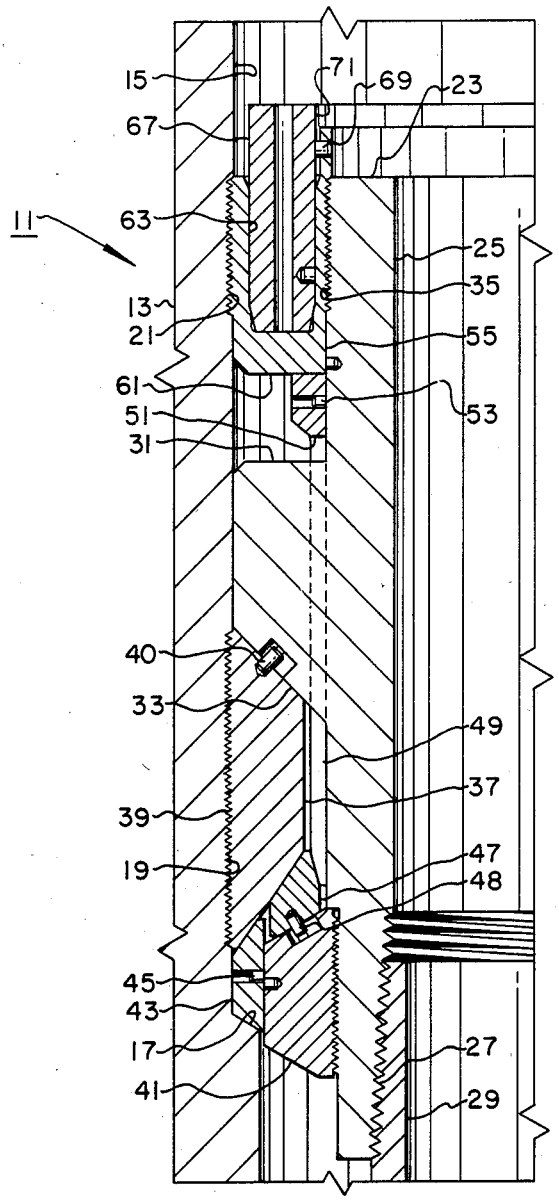
FIG. 3 is a view of the casing hanger of FIG. 1, taken along the same vertical section as in FIG. 2 and showing the seal means and the locking means in the set position.

As can be seen by comparing FIGS. 2 and 3, the weight of the string 29 will shear the pin 45, causing the hanger body 23 and inner ring 41 to move downward a short distance with respect to the outer ring 43. This downward movement causes the reacting surface 33 and the upper edge of the outer ring 43 to urge the split ring 37 radially outward for engaging wickers 39 with wickers 19. When moving outwardly, pin 40 (FIG. 2) will move outwardly within its enlarged slot or cavity.

The split ring 37 is maintained in the outward position by retaining means which includes an expandable ring 47 and a plurality of wedging fingers 49. Expandable ring 47 is split to allow radial movement outward as can be seen by comparing FIGS. 1 and 2. Expandable ring 47 has a tapered lower edge carried on a tapered upper edge of inner ring 41 and retained by a pin 48. Pin 48 locates in an enlarged slot in inner ring 41 to allow radial movement. The upper edge of the expandable ring 47 is tapered and mates slidingly with the lowered tapered edge of the split ring 37.

Each wedging finger 49 is integrally formed with a collar 51 at the top. Collar 51 is secured to the hanger body 23 above flange 31 by means of a shear pin 53. Each wedge finger 49 (only one shown) extends through one of the slots 32 spaced around the flange 31. Each wedge finger 49 extends within the inner diameter of split ring 37 and is axially movable between the expandable position shown in FIG. 1 and the lower position shown in FIG. 2. Each wedge finger 49 has a tapered surface on its lower end, which slides between the expandable ring 47 and the hanger body 23 when moved to its downward position as shown in FIG. 2. The wedge fingers 49 force the upper ring 47 radially outward into tight contact with the lower edge of the split ring 37, to retain the split ring in the engaged position shown in FIG. 2. The fingers 49 and upper ring 47 cause the split ring 37 to positively lock the body 23 to the wellhead 13 to prevent any axial movement.

The collar 51 and the wedge fingers 49 are moved downwardly by force of a seal ring 55, which also serves to seal the casing hanger 11. Seal ring 55 is a "U" shaped, soft metal ring, which deforms when set to form a metal-to-metal seal. Seal ring 55 is preferably formed of a low carbon steel with a hardness of about 150 Brinnell. Seal ring 55 has inner and outer sidewalls 57 and 59 which are cylindrical and concentric with the axis of the wellhead 13. Prior to deformation, the inner and outer sidewalls 57 and 59 are dimensioned such that the seal ring 55 can slide without restriction into the annular space between the hanger body 23 and the bore 15. Seal ring 55 has a closed bottom 61 that is located in a plane perpendicular to the axis of the sidewalls 57 and 59. A rectangular cavity 63 is formed in seal ring 55 and faces upwardly. Cavity 63 is annular and has a closed bottom defined by bottom 61. Cativy 63 has a tapered and enlarged portion 65 on its upper end.

A metal wedge ring 67 has its lower edge carried in the enlarged portion 65 of cavity 63 by means of a shear pin 69. Wedge ring 67 is annular, and will not deform under normal operation, rather serves to deform the seal ring 55. Wedge ring 67 has an inner sidewall 71 and an outer sidewall 73 that are cylindrical, parallel and concentric with the axis of the seal ring 55. The cross-sectional dimension between sidewalls 71 and 73 is greater than the distance across cavity 63. A plurality of passages 75 extend through the top and bottom of the wedge ring 67 to allow the displacement of liquid when the wedge ring is pressed into the cavity 63, as shown in FIG. 3.

In operation, the string of casing or tubing will be secured to the lower end of the casing hanger body 23 and lowered through risers (not shown) extending from a drilling vessel into the wellhead 13 by means of a handling tool (not shown). Seal ring 55 and wedge ring 67 could be lowered with the same handling tool during the same run, or they could be lowered in a second or subsequent run. When the outer ring 43 contacts the wellhead shoulder 17, further downward movement caused by the weight of string 29 will shear pin 45, causing the split ring 37 to move outward into engagement with the wickers 19. Then, if the string 29 is casing, cement will normally be pumped downward through the passage 25 and through the casing 29 to cement the casing 29 into the well. Liquid in the well will be displaced from the annulus between the casing 29 and the wellbore through passages (not shown) located in inner ring 41, upper ring 47, and split ring 37. The displaced liquid will flow through the slots 32 and to the surface.

Once the cement has set, the handling tool (not shown), moves the seal 55 downward without rotation, causing its bottom 61 to contact the collar 51, pushing the expandable ring 47 outwardly to retain the split ring 37 in the locked and engaged position. Shear pin 53 will shear at this time. Then, the handling tool applies force without rotating to the wedge ring 67. This force deforms the seal ring 55, forcing the inner sidewall 57 radially inward and the outer sidewall 59 radially outward. Shear pin 69 will shear. The wedging force will cause the soft metal of the seal ring 55 to sealingly embed within the wickers 21 and 35. Any fluid that tends to leak past the seal ring 55 will be trapped in the wickers 21 and 35.

The invention has significant advantages. The locking portions of the casing hanger assembly positively lock the casing hanger body to the wellhead. This prevents any axial movement of the hanger body relative to the wellhead that might otherwise occur due to the thermal changes. The lack of movement of the hanger body relative to the wellhead avoids flexing of the metal seal, which could deteriorate the seal. The metal seal has a large cylindrical surface which provides good sealing, enhanced by the wickers. The soft metal seal does not deform the wellhead, enabling the casing hanger to be pulled and another substituted in the same place. The cooperation between the locking means and the seal means enables the casing to be lowered into place, cemented, locked and sealed all in a single run, if desired.

While the invention has been shown in only one of its forms, it should be apparent to those skilled in the art that it is not so limited but is susceptible to various changes without departing from the scope of the invention.

We claim:

1. For use in a wellhead member having a bore, an improved hanger adapted to be mounted in the bore for supporting a string of conduit, comprising in combination:

a hanger body having a lower end to which the conduit is adapted to be secured;

a plurality of parallel wickers formed on the exterior of the body for alignment with a plurality of parallel wickers formed in the bore;

locking means positionable in an annular clearance provided between the body and the bore for locking the body in the bore;

a deformable metal seal ring positionable in the clearance between the wickers of the bore and wickers of the body, having inner and outer sidewalls; and wedge means for urging the sidewalls radially apart to embed within the wickers of the body and the bore.

2. For use in a wellhead member having a bore, an improved hanger adapted to be mounted in the bore for supporting a string of conduit, comprising in combination:

a hanger body having a lower end to which the string of conduit is adapted to be secured, and a cylindrical wall dimensioned to define an annular clearance between the bore and the body;

a set of wickers formed on the exterior of the body wall in alignment with a set of wickers formed in the bore;

locking means positionable in the annular clearance for locking the body in the bore;

a deformable metal seal ring adapted to be located in the clearance between the sets of wickers of the body and bore, having inner and outer cylindrical sidewalls, separated by an upwardly facing annular cavity; and a wedge ring movably carried with the seal ring, the wedge ring having a greater cross-sectional dimension than the cross-sectional dimension of the cavity, so that downward movement of the wedge ring with respect to the seal ring urges the seal ring sidewalls radially apart to embed within the wickers of the body and the bore.

3. In a wellhead member having a bore and an upwardly facing shoulder located therein, an improved hanger adapted to be supported to the shoulder for carrying a string of conduit, comprising in combination:

a hanger body having a lower end to which the conduit is adapted to be secured, and a cylindrical wall dimensioned for defining an annular clearance between the bore and the body;

a radially protruding flange located between the ends of the hanger body, defining an upper annular clearance above the flange between the hanger body and the bore, and a lower annular clearance below the flange between the hanger body and bore;

a reacting surface located on the lower side of the flange that is inclined and downwardly facing;

a split ring positionable in the clearance below the reacting surface, having a set of grooves on an outer sidewall for alignment with a set of grooves formed in the bore;

reacting means movably carried by the body below the flange for urging the split ring to slide against the reacting surface outwardly into engagement with the grooves in the bore when the reacting means contacts the shoulder, and the body and string of conduit are moved downwardly relative to the shoulder;

a set of wickers formed on the exterior of the body wall above the flange in alignment with a set of wickers formed in the bore;

a deformable metal seal ring adapted to be located in the clearance above the flange between the wickers of the bore and the wickers of the body, having inner and outer sidewalls separated by an upwardly facing annular cavity; and a wedge ring movably carried with the seal ring, the wedge ring having a greater cross-sectional dimension than the cross-sectional dimension of the cavity, so that downward movement of the wedge ring with respect to the seal ring urges the seal ring sidewalls radially apart to embed within the wickers of the body and the wickers of the bore.

4. In a wellhead member having a bore, an upwardly facing shoulder located therein, an improved hanger adapted to be supported on the shoulder for carrying a string of conduit, comprising in combination:

upper and lower wickers formed in the bore above the shoulder and spaced axially apart;

a hanger body having a lower end to which the conduit is adapted to be secured, and a cylindrical wall dimensioned for defining an annular clearance between the bore and the body;

a set of wickers formed on the exterior of the body wall in alignment with the upper set of wickers formed in the bore;

a split ring positionable in the clearance, having a set of wickers on an outer sidewall in alignment with the lower set of wickers formed in the bore;

reacting means movably carried by the body for forcing the split ring outwardly into engagement with the lower set of wickers upon contact with the shoulder in the bore;

a plurality of wedge finger means carried by the body between the split ring and the body wall for retaining the split ring in engagement with the bore when the wedge finger means is moved downwardly with respect to the split ring;

a deformable metal seal ring adapted to be located in the clearance between the set of wickers of the body and the upper set of wickers of the bore, having inner and outer cylindrical sidewalls separated by an upwardly facing annular cavity;

the seal ring adapted to contact the wedge finger means and move it downwardly with respect to the body when the seal ring is moved downwardly; and a wedge ring movably carried with the seal ring, the wedge ring having a greater cross-sectional dimension than the cross-sectional dimension of the cavity, so the downward movement of the wedge ring with respect to the seal ring urges the seal ring sidewalls radially apart to embed and seal within the wickers of the body and the bore.

5. In a wellhead member having a bore, an upwardly facing shoulder located therein, and axially spaced-apart upper and lower wickers located above the shoulder, an improved hanger adapted to be supported on the shoulder for carrying a string of conduit, comprising in combination:

a hanger body having a lower end containing threads for threadably receiving the string of conduit, an upper end with a cylindrical exterior, and a radially protruding flange located between the ends and in contact with the bore, defining an upper annular clearance above the flange between the hanger body and bore and a lower annular clearance below the flange between the hanger body and bore;

a split ring carried below the flange by the body within the lower annular clearance;

reacting means carried by the body below the split ring for contact with the shoulder to support the hanger and for urging the split ring radially outward to engage the bore when the hanger body is removed downwardly after contact of the reacting means with the shoulder;

retaining means for retaining the split ring in the engaged position, the retaining means having a plurality of wedge fingers which extend through slots provided in the flange for wedging the split ring in the engaged position when the fingers are moved downwardly with respect to the hanger body, the fingers protruding above the top of the flange;

a deformable metal seal ring adapted to be located in the upper clearance above the flange, having inner and outer sidewalls and a lower edge which is adapted to contact the upper ends of the fingers to move the fingers downwardly when the seal ring is moved downwardly with respect to the hanger body; and wedge means for wedging the sidewalls of the seal ring radially outward to deform against the hanger body and the bore.

6. A method of mounting a hanger body in a bore of a wellhead member which has an upwardly facing shoulder located therein, the method comprising in combination:

securing the lower end of the hanger body to a string of conduit;

mounting a locking means around the hanger body;

lowering the hanger body and the locking means into the bore, and locking the hanger body to the wellhead member with the locking means, the hanger body and wellhead member defining an annular clearance facing upwardly;

providing a set of wickers in the bore of the wellhead member;

providing a set of wickers on the exterior of the hanger body which align with the wickers in the bore when the hanger body is locked to the wellhead member;

lowering a deformable metal seal ring into the annular clearance above the locking means, the seal ring having inner and outer sidewalls separated by an upwardly facing annular cavity; and lowering a metal wedge ring downwardly into the cavity, and wedging the sidewalls outwardly with the wedge ring to cause the sidewalls to embed within the wickers in the hanger body and the bore.

* * * * *